US011296460B2

(12) United States Patent
Kurita

(10) Patent No.: US 11,296,460 B2
(45) Date of Patent: Apr. 5, 2022

(54) CONNECTOR, CONNECTOR POSITION ASSURANCE MEMBER AND WIRING HARNESS

(71) Applicant: Sumitomo Wiring Systems, Ltd., Yokkaichi (JP)

(72) Inventor: Atsushi Kurita, Yokkaichi (JP)

(73) Assignee: Sumitomo Wiring Systems Ltd., Yokkaichi (JP)

( * ) Notice: Subject to any disclaimer, the term of this patent is extended or adjusted under 35 U.S.C. 154(b) by 0 days.

(21) Appl. No.: 16/907,158

(22) Filed: Jun. 19, 2020

(65) Prior Publication Data

US 2020/0412055 A1 Dec. 31, 2020

(30) Foreign Application Priority Data

Jun. 25, 2019 (JP) ..... JP2019-117098

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC ..... H01R 13/6272; H01R 13/6275; H01R 13/641; H01R 13/4223; H01R 13/4362; H01R 13/639
USPC ..... 439/352, 357, 358, 489, 595, 752
See application file for complete search history.

(56) References Cited

U.S. PATENT DOCUMENTS 5,720,623 A * 2/1998 Polenick ..... H01R 13/641 439/352
5,775,930 A * 7/1998 Model ..... H01R 13/641 439/352
6,261,115 B1 * 7/2001 Pederson ..... H01R 13/6272 439/352
6,435,895 B1 * 8/2002 Fink ..... H01R 13/6272 439/352
6,582,243 B2 * 6/2003 Endo ..... H01R 13/6272 439/352
6,712,635 B1 * 3/2004 Nimura ..... H01R 13/6272 439/352

(Continued)

FOREIGN PATENT DOCUMENTS

JP 2012-064461 3/2012

*Primary Examiner* — Thanh Tam T Le
(74) *Attorney, Agent, or Firm* — Gerald E. Hespos; Michael J. Porco; Matthew T. Hespos

(57) ABSTRACT

A connector position assurance member (60) includes a body (61), a resiliently displaceable lock (70) projecting forward from a front of the body (61) and a push-in suppressing member (80) projecting rearward from a rear of the body (61). The housing (30) includes a receptacle (31) and a lock arm (40) provided on an upper surface of the receptacle (31). The lock arm (40) includes a locking portion (44) to be locked to a projection (102) of a mating housing (100) and a connection releasing portion (45) for displacing the locking portion (44) by being pushed toward an outer peripheral surface of the receptacle (31). With the connector position assurance member (60) at a connection assurance position (CAP), the lock (70) is locked to the locking portion (44) and the push-in suppressing member (80) is between the upper surface of the receptacle (31) and the connection releasing portion (45).

9 Claims, 14 Drawing Sheets

(56) References Cited

U.S. PATENT DOCUMENTS

| | | | | |
|---|---|---|---|---|
| 6,824,417 | B1 * | 11/2004 | Nimura | H01R 13/641 439/352 |
| 7,326,074 | B1 * | 2/2008 | Lim | H01R 13/629 439/352 |
| 7,544,081 | B2 * | 6/2009 | Lim | H01R 13/4361 439/352 |
| 7,682,181 | B1 * | 3/2010 | Jones, Jr. | H01R 13/639 439/352 |
| 7,909,638 | B2 * | 3/2011 | Seo | H01R 13/6272 439/489 |
| 8,016,606 | B1 * | 9/2011 | Kwan | H01R 13/641 439/352 |
| 8,926,356 | B2 * | 1/2015 | Kon | H01R 13/6272 439/352 |
| 9,142,919 | B2 * | 9/2015 | Osada | H01R 13/642 |
| 9,160,095 | B2 * | 10/2015 | Littek | H01R 13/422 |
| 9,425,534 | B2 * | 8/2016 | Schmidt | H01R 13/6272 |
| 9,490,576 | B2 * | 11/2016 | Plazio | H01R 13/641 |
| 9,929,509 | B1 * | 3/2018 | Penn | H01R 13/641 |
| 9,979,131 | B2 * | 5/2018 | Venkatesan | H01R 13/639 |
| 2013/0210266 | A1 | 8/2013 | Osada et al. | |

* cited by examiner

CARP

CONNECTOR, CONNECTOR POSITION ASSURANCE MEMBER AND WIRING HARNESS

BACKGROUND

Field of the Invention

This disclosure relates to a connector, a connector position assurance member and a wiring harness.

Related Art

A connector composed of a male connector, a female connector to be connected to the male connector and a connector position assurance (CPA) member slidably mounted outside the female connector is known as an example of a conventional connector (see, for example, Japanese Unexamined Patent Publication No. 2012-064461). The CPA member includes a cantilevered CPA lock.

In the connector of this type, if the male and female connectors are connected, a female-side lock of the female connector rides over a male-side lock of the male connector for locking. If the CPA member is slid in a connecting direction in this state, the CPA lock rides over the female-side lock and the male-side lock. In this way, the connection of the male connector and the female connector is assured.

The above-described connector is provided with a connection releasing portion for releasing the connection of the female connector and the male connector. The female-side lock and the male-side lock are unlocked to release the connection of the male and female connectors by pushing the connection releasing portion when the CPA member is at a connection assurance release position for releasing the connection assurance. On the other hand, the CPA lock is arranged to cover the female-side lock when the CPA member is in a connection assurance state. Thus, a displacement of the female-side lock is suppressed by the CPA lock, and the locking of the female-side and male-side locks is maintained even if the connection releasing portion is pushed. However, in the conventional connector, if the connection releasing portion is pushed excessively even when the CPA member is in the connection assurance state, the CPA lock may be deflected. Thus, the female-side and male-side locks may be unlocked and the connection of the female and male connectors may be released.

The present disclosure aims to provide a connector, a connector position assurance member and a wiring harness capable of suppressing an unintended release of connector connection.

SUMMARY

A connector of this disclosure includes a housing to be connected to a mating housing, and a connector position assurance member for performing connection assurance of the housing and the mating housing. The connector position assurance member is mounted on the housing relatively displaceably between a connection assurance position where the connection assurance is performed and a connection assurance release position where the connection assurance is released with the housing and the mating housing properly connected. The connector position assurance member includes a body, a resiliently displaceable lock formed to project in a first direction from a first end part of the body and a push-in suppressing member formed to project in a second direction substantially opposite to the first direction from a second end part of the body. The housing includes a receptacle and a lock arm provided on an outer peripheral surface of the receptacle. The lock arm includes a locking portion to be locked to a projection of the mating housing and a connection releasing portion for displacing the locking portion by being pushed toward the outer peripheral surface of the receptacle. The lock is locked to the locking portion and the push-in suppressing member is arranged between the outer peripheral surface of the receptacle and the connection releasing portion with the connector position assurance member arranged at the connection assurance position.

Accordingly, if the connector position assurance member is arranged at the connection assurance position where the connection assurance of the housing and the mating housing is performed, the suppressing member of the connector position assurance member is arranged between the outer peripheral surface of the receptacle and the connection releasing portion. Thus, if the connection releasing portion is displaced toward the outer peripheral surface of the receptacle with the connector position assurance member arranged at the connection assurance position, the connection releasing portion contacts the suppressing member to suppress excessive pushing of the connection releasing portion. In this way, an unintended displacement of the locking portion of the lock arm is suppressed. Thus, the locking of the locking portion and the projection of the mating housing is not released unintendedly. As a result, it can be suitably suppressed that the connection of the housing and the mating housing is not released unintendedly.

The lock arm may include a base end portion formed to project outward from the outer peripheral surface of the receptacle and a lock arm body having a lengthwise intermediate part coupled to a projecting tip of the base end portion. The locking portion is formed on one lengthwise end part of the lock arm body and the connection releasing portion is formed on the other lengthwise end part of the lock arm body. A space is formed between the connection releasing portion and the outer peripheral surface of the receptacle with the connector position assurance member arranged at the connection assurance release position. The suppressing member is arranged at least partly in the space with the connector position assurance member arranged at the connection assurance position.

Accordingly, the space is formed between the connection releasing portion and the outer peripheral surface of the receptacle with the connector position assurance member arranged at the connection assurance release position. Specifically, the connection releasing portion is provided at a position separated from the outer peripheral surface of the receptacle. If the connection releasing portion is pushed toward the outer peripheral surface of the receptacle, i.e. if the connection releasing portion enters the space, the locking portion is displaced in a direction away from the outer peripheral surface of the receptacle with the base end portion as a fulcrum. However, the suppressing member is arranged in the space if the connector position assurance member at the connection assurance position. Thus, the entrance of the connection releasing portion into the space is suppressed. In this way, a displacement of the locking portion in the direction away from the outer peripheral surface of the receptacle can be suppressed.

The suppressing member may be arranged on an upper surface of the receptacle. The suppressing member is in the form of a frame substantially extending in a length direction of the connector position assurance member from an end part of the body. An inserting portion (particularly substantially in the form of a flat plate) is provided on a projecting tip of the suppressing member, an upper surface of the inserting portion is provided below that of the body, and the inserting portion is inserted at least partly between the upper surface of the receptacle and a lower surface of the connection releasing portion with the connector position assurance member arranged at the connection assurance position.

Accordingly, if the connector position assurance member is arranged at the connection assurance position, the inserting portion provided on the projecting tip part of the suppressing member is inserted between the upper surface of the receptacle and the lower surface of the connection releasing portion. In this way, the connection releasing portion cannot be pushed downwardly toward the upper surface of the receptacle.

The connector position assurance member may move in a sliding direction from the inserting portion toward the body when being displaced from the connection assurance release position to the connection assurance position, and an inclined surface inclined down or in from the projecting tip part toward an end part of the inserting portion on the side of the body is formed on the upper surface of the inserting portion.

Accordingly, the inclined surface inclined down or in toward the end part on the side of the body is formed on the upper surface of the inserting portion. Specifically, a part of the inserting portion to be inserted first between the upper surface of the receptacle and the lower surface of the connection releasing portion is formed on the inclined surface. In this way, the contact of the inserting portion with the connection releasing portion can be suppressed when inserting the inserting portion between the upper surface of the receptacle and the lower surface of the connection releasing portion. As a result, an unintended displacement of the connection releasing portion is suppressed.

The connector position assurance member may further include an operating portion (particularly substantially in the form of a flat plate) formed to project out from an outer surface of the projecting tip part of the suppressing member. Accordingly, the operating portion extending on a plane orthogonal to the sliding direction of the connector position assurance member is provided on the connector position assurance member. By pushing this operating portion in the sliding direction, the entire connector position assurance member can be moved in the sliding direction. As just described, the entire connector position assurance member can be moved in the sliding direction and the connector position assurance member can be displaced from the connection assurance release position to the connection assurance position by pushing the operating portion only in one direction. In this way, the operability of an operation of displacing the connector position assurance member to the connection assurance position can be improved.

The operating portion may extend over substantially an entire width orthogonal to the length direction of the connector position assurance member. According to this configuration, the operating portion has a wide surface area. Thus, the operating portion is pushed more easily in the sliding direction. In this way, the operation of displacing the connector position assurance member to the connection assurance position can be further improved.

The connector position assurance member further may include connecting portion(s) connecting widthwise end surface(s) of the suppressing member and widthwise end surface(s) of the operating portion. The housing further may include two side walls formed on the receptacle to at least partly sandwich the lock arm, and the connecting portions are arranged between the side walls. Accordingly, if the connector position assurance member is inclined in the width direction such as when the connector position assurance member moves along the sliding direction, the connecting portion can be brought into contact with the side wall. The contact of the connecting portion and the side wall prevents inclination of the connector position assurance member in the width direction.

The lock arm may be substantially in the form of a frame having an opening. An engaging portion projecting toward the receptacle is formed on a surface of the body facing toward the receptacle, and the connector position assurance member is mounted on the housing so that the engaging portion is fit at least partly into the opening. Accordingly, the engaging portion of the connector position assurance member is fit at least partly into the opening of the lock arm. Thus, the engaging portion moves in the opening when the connector position assurance member is displaced between the connection assurance release position and the connection assurance position. In this way, a movement of the engaging portion is guided by a frame part of the opening to prevent inclination of the connector position assurance member.

A connector position assurance member of the present disclosure is mounted or mountable on or to a housing of a connector to perform connection assurance of the housing and a mating housing and includes a body, a resiliently displaceable lock formed to project in a first direction from a first end part of the body, and a suppressing member formed to project in a second direction opposite to the first direction from a second end part of the body. Thus, the suppressing member includes an inserting portion substantially in the form of a flat plate, and an upper surface of the inserting portion is formed below that of the body. By mounting the above-described connector position assurance member on the housing, the inserting portion can be inserted at least partly between the outer peripheral surface of the receptacle and the lower surface of the connection releasing portion. In this way, an unintended release of the connector connection can be suppressed.

A wiring harness of the present disclosure includes any one of the above embodiments of a connector, and a wire connected to the connector. Accordingly, an unintended release of the connector connection can be suppressed in the wiring harness including the aforementioned connector and the wire.

Furthermore, a connector position assurance member of the present disclosure is mounted or mountable on or to a housing of a connector to perform connection assurance of the housing and a mating housing and includes a body, a resiliently displaceable lock portion formed to project in a first direction from a first end part of the body portion, and a suppressing member formed to project in a second direction opposite to the first direction from a second end part of the body portion, wherein the suppressing member includes an inserting portion substantially in the form of a flat plate, and an upper surface of the inserting portion is formed below that of the body.

According to the connector, connector position assurance member and wiring harness of the present disclosure, an effect of being able to suppress an unintended release of connector connection is achieved.

These and other features and advantages of the invention will become more apparent upon reading the following detailed description and accompanying drawings. It should be understood that even though embodiments are described separately, single features may be combined to additional embodiments.

DETAILED DESCRIPTION

Specific examples of a connector and a wiring harness of the present disclosure are described with reference to the drawings below. In each drawing, a configuration may be partially shown in an exaggerated or simplified manner for the convenience of description. Further, a dimensional ratio of each component may be different in each figure. "Parallel" and "orthogonal" in this specification are used not only in the case of strictly intending parallel and orthogonal, but also in the case of intending substantially parallel and orthogonal within a range in which functions and effects in this embodiment are achieved. Note that the present invention is not limited to these illustrations and is intended to be indicated by claims and include all changes within the scope of claims and within the meaning and scope of equivalents.

(Overall Configuration of Wiring Harness W1)

Figure 1:
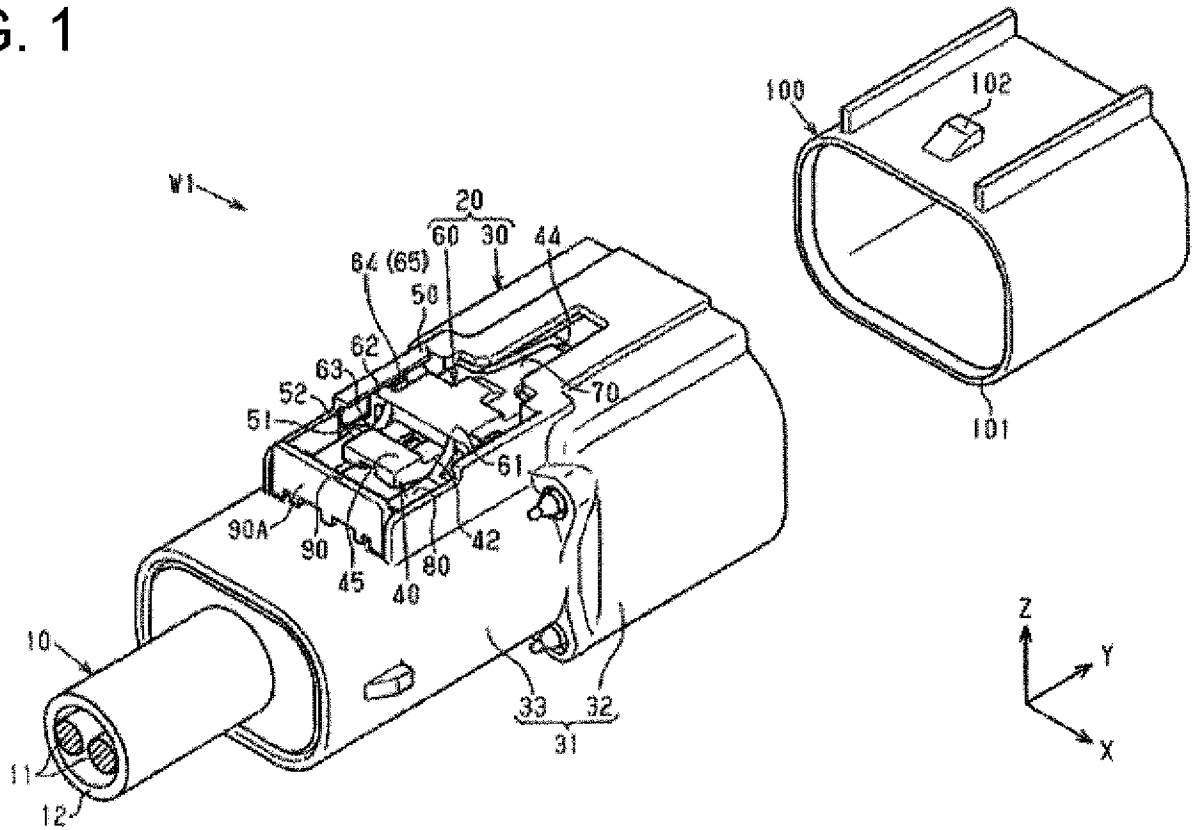
FIG. 1 is an exploded perspective view showing a wiring harness of one embodiment.

As shown in FIG. 1, a wiring harness W1 includes a wire 10 and a connector 20 mounted on an end part of the wire 10. The wire 10 includes, for example, a plurality of conductive paths 11 and a coating member 12 collectively covering the plurality of conductive paths 11.

Note that, out of XYZ axes in each figure, the X axis represents a width direction of the connector 20, the Y axis represents a front-rear direction of the connector 20 orthogonal to the X axis, and the Z axis represents a vertical direction of the connector 20 orthogonal to an XY plane. In the following description, a direction extending along the X axis is referred to as a width direction X, a direction extending along the Y axis is referred to as a front-rear direction Y and a direction extending along the Z axis is referred to as a vertical direction Z for the sake of convenience. Further, in the following description, directions of arrows Z, Y and X in FIG. 1 are an upward direction, a forward direction and a rightward direction.

(Overall Configuration of Connector 20)

The connector 20 includes a housing 30 and a connector position assurance member 60 slidably mounted on the housing 30. In the connector 20 of this embodiment, the housing 30 and the connector position assurance member 60 are configured as separate components. The housing 30 is, for example, a female housing. A male mating housing 100 is, for example, connected to the housing 30. In this embodiment, a connecting direction of the housing 30 and the mating housing 100 coincides with the front-rear direction Y. The mating housing 100 includes a tubular mating receptacle 101 and a projection 102 projecting upward from the upper surface of the mating receptacle 101. The mating receptacle 101 is, for example, formed to be open forward and rearward. The mating receptacle 101 is, for example, formed into a rectangular or polygonal tube. The projection 102 is, for example, formed at a position near a rear end on the upper surface of the mating receptacle 101.

The connector position assurance member 60 is a member for assuring connection by detecting that the housing 30 and the mating housing 100 are properly connected, and is a functional member for realizing so-called CPA (Connector Position Assurance).

Figure 2:
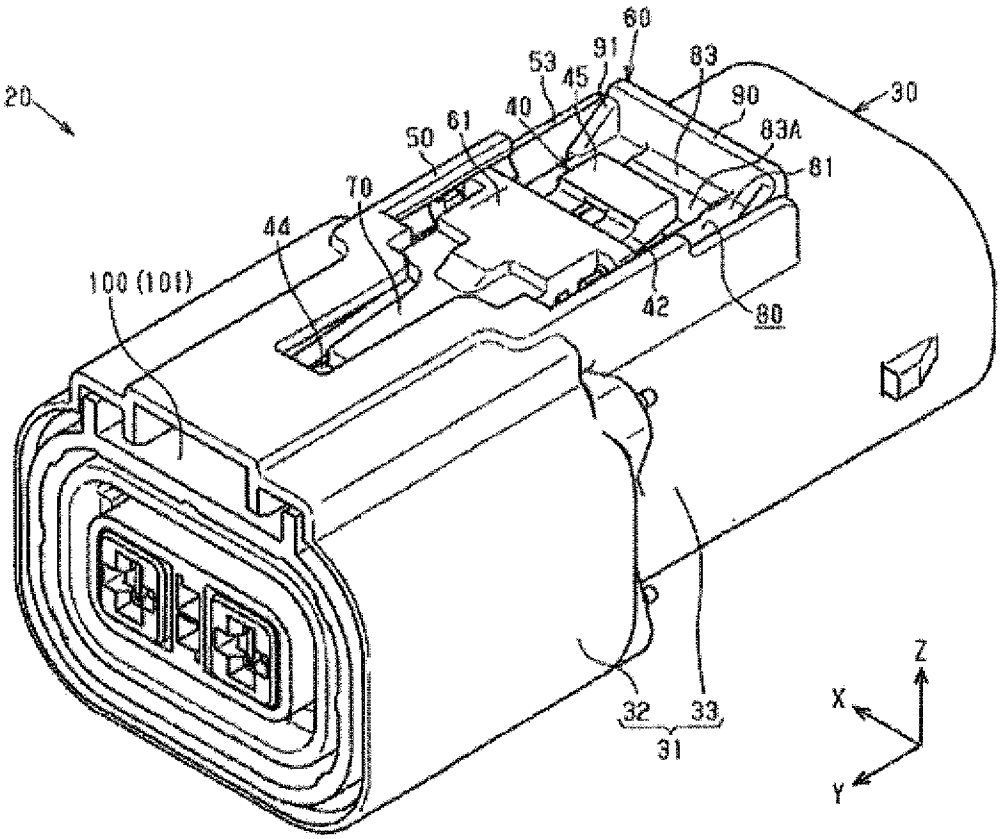
FIG. 2 is a front perspective view of the connector of FIG. 1.
Figure 3:
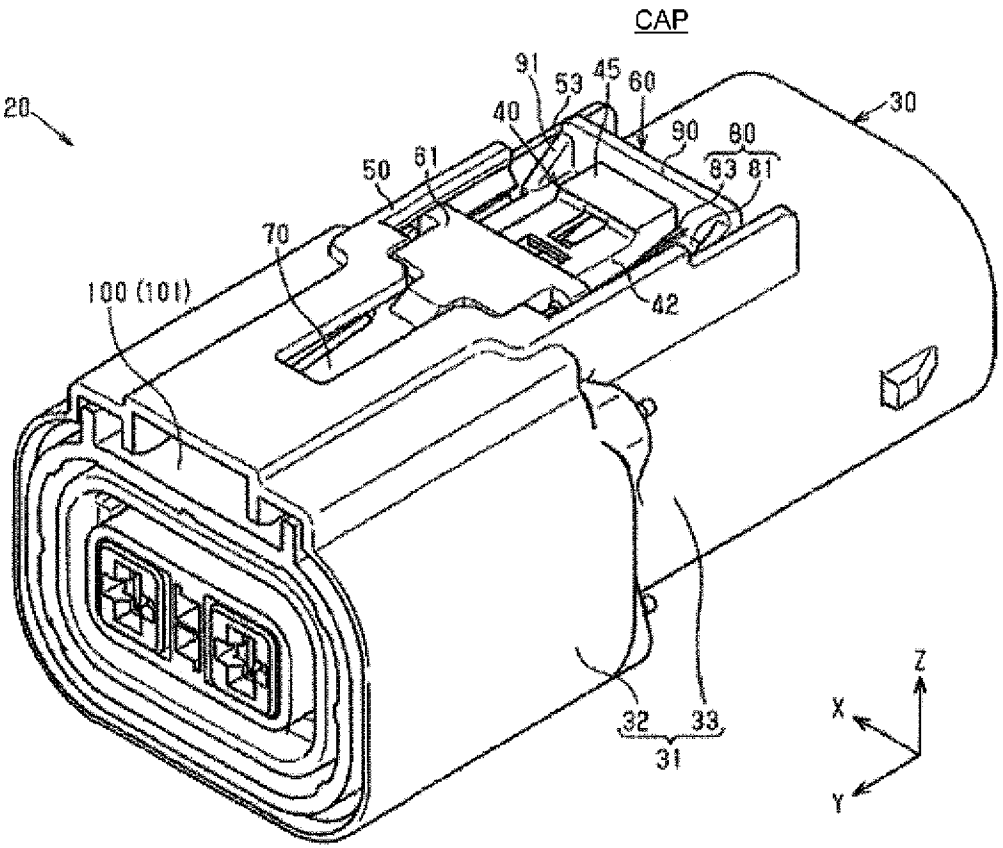
FIG. 3 is a front perspective view of the connector of FIG. 1.

FIGS. 2 and 3 show a state where the housing 30 and the mating housing 100 are properly connected. Further, FIG. 2 shows a state where the connector position assurance member 60 is arranged at a connection assurance release position CARP where the connection assurance of the housing 30 and the mating housing 100 is released. Further, FIG. 3 shows a state where the connector position assurance member 60 is arranged at a connection assurance position CAP where the connection of the housing 30 and the mating housing 101 is assured. The connector position assurance member 60 is so mounted on or to the housing 30 as to be relatively displaceable between the connection assurance release position CARP shown in FIG. 2 and the connection assurance position CAP shown in FIG. 3 with the housing 30 and the mating housing 100 properly connected. The connector position assurance member 60 is, for example, mounted on the housing 30 slidably along the front-rear direction Y. A sliding direction of the connector position assurance member 60 of this embodiment substantially coincides with the front-rear direction Y.

(Configuration of Housing 30)

Figure 4:
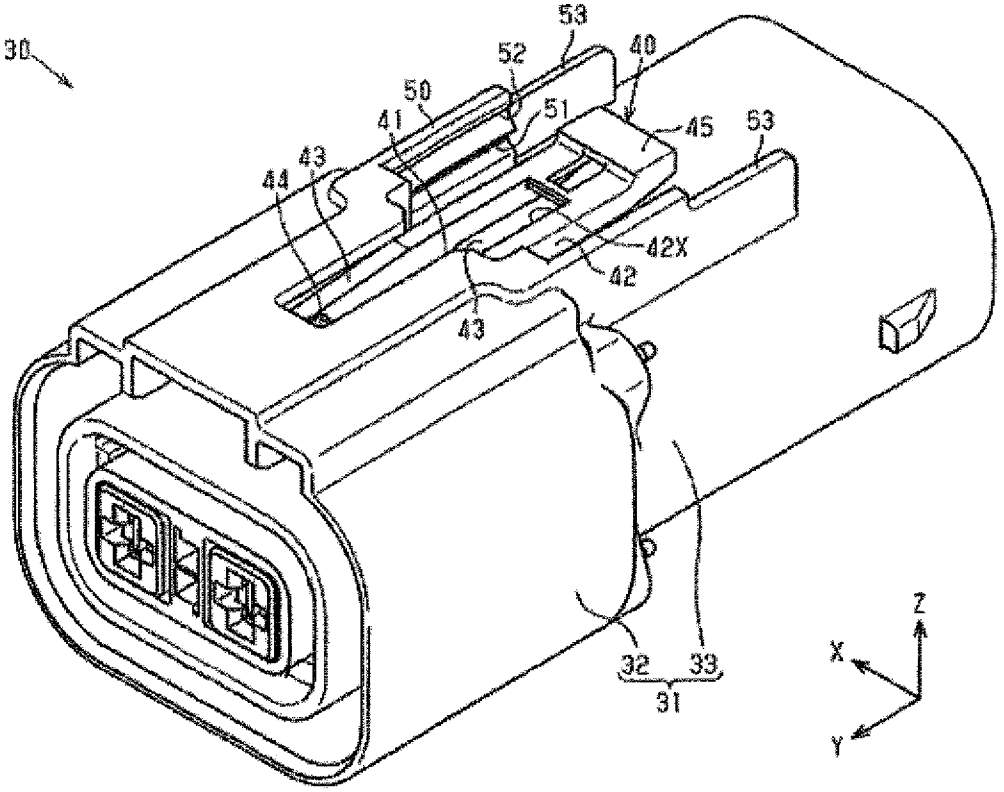
FIG. 4 is a front perspective view showing a housing of FIG. 1.
Figure 5:
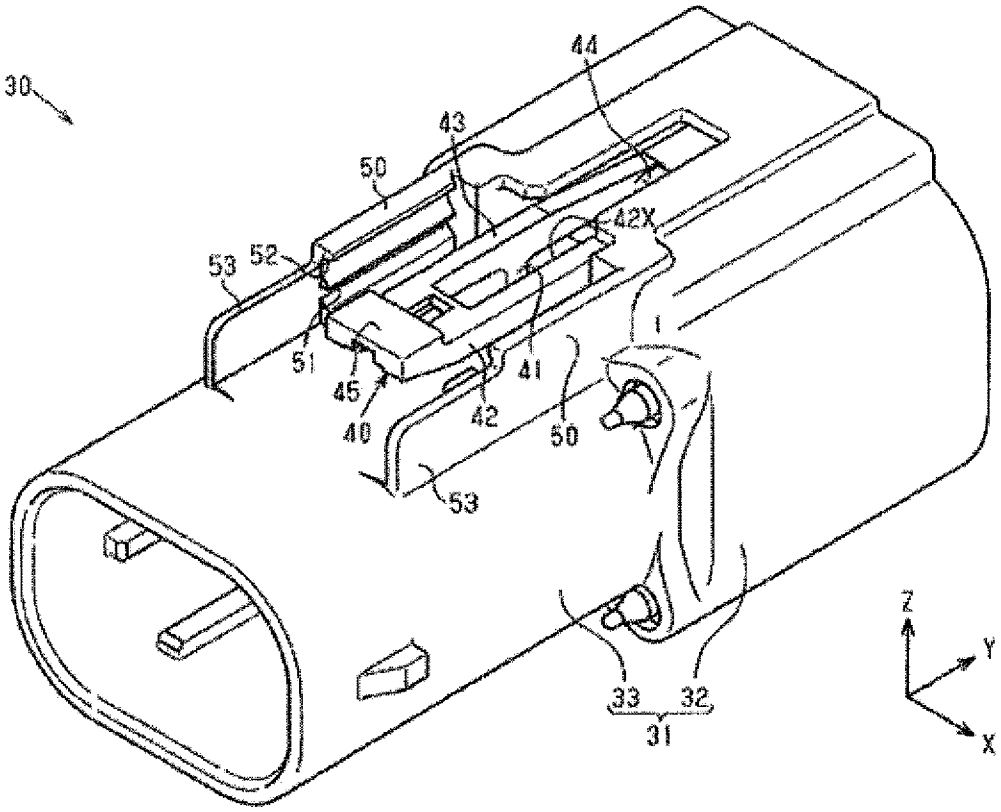
FIG. 5 is a rear perspective view of the housing of FIG. 1.

As shown in FIGS. 4 and 5, the housing 30 includes a tubular receptacle 31, a lock arm 40 provided on the outer peripheral surface (here, upper surface) of the receptacle 31 and a pair of side walls 50 provided on both end parts in the width direction X of the upper surface of the receptacle 31. The receptacle 31 is, for example, formed to be open forward and rearward.

(Configuration of Receptacle 31)

The receptacle 31 includes a tubular front receptacle 32 open forward with respect to the front-rear direction Y and a tubular rear receptacle 33 open rearward with respect to the front-rear direction Y. The front and rear receptacles 32, 33 are, for example, formed into a rectangular or polygonal tube shape. The front receptacle 32 is, for example, formed one size larger (e.g. about 10% or more larger in diameter) than the rear receptacle 33.

(Configuration of Lock Arm 40)

The lock arm 40 includes, for example, a base end 41 formed to project upward from the upper surface of the receptacle 31 (here, the rear receptacle 33), and a lock arm body 42 coupled to an upper or distal end of the base end 41. The lock arm body 42 has, for example, a rectangular or polygonal shape long in the front-rear direction Y and is formed to be open in a frame-like manner. Specifically, the lock arm body 42 includes an opening 42X extending in the front-rear direction Y. The upper end of the base end 41 is connected to the lower surface of the lock arm body 42. The base end 41 is, for example, coupled to an intermediate part in a length direction (here, front-rear direction Y) of the lock arm body 42. The lock arm body 42 is, for example, supported only on the base end 41. The lock arm body 42 is, for example, provided at a position spaced upwardly from the upper surface of the receptacle 31. Specifically, a space is formed between the lower surface of the lock arm body 42 and the upper surface of the receptacle 31.

The lock arm body 42 includes, for example, two arms 43 substantially extending in the length direction of the lock arm body 42, a locking portion 44 connecting lengthwise front ends of the arms 43 and a connection releasing portion 45 connecting the rear ends of the arms 43. The lock arm body 42 is, for example, formed into a frame shape by the pair of arm portions 43, the locking portion 44 and the connection releasing portion 45.

The arms 43 are at positions away from each other in the width direction X and are substantially parallel to each other along the front-rear direction Y. For example, the upper end of the base end 41 is connected to the lower surface of a lengthwise intermediate part of each arm portion 43. In other words, the base end 41 is connected to the lower surface of each arm 43 between the locking portion 44 and the connection releasing portion 45.

The locking portion 44 extends in the width direction X between the arms 43. The opening 42X of the lock arm body 42 is formed behind the locking portion 44. The locking portion 44 is, for example, locked to the projection 102 of the mating housing 100 shown in FIG. 1. For example, with the housing 30 and the mating housing 100 properly connected, the projection 102 is fit in the opening 42X of the lock arm body 42 and the projection 102 is locked to the locking portion 44. The connected state of the housing 30 and the mating housing 100 is maintained by the locking of the projection 102 and the locking portion 44.

The connection releasing portion 45 is formed to be able to press the lock arm 40 from above. The connection releasing portion 45 is, for example, a flat plate and extends in the width direction X from a rear end part of one arm 43 to that of the other arm 43. The upper surface of the connection releasing portion 45 is provided above that of each arm 43. For example, if a worker presses the connection releasing portion 45 down toward the upper surface of the receptacle 31 using a finger or the like, the lock arm 40 is displaceable in a seesaw manner with the base end 41 as a fulcrum. Specifically, if the connection releasing portion 45 is pressed down, a part of the lock arm body 42 located in front of the base end 41 is displaced up and the locking portion 44 is displaced up. For example, if the connection releasing portion 45 is pressed down and the locking portion 44 is displaced up, the locking of the locking portion 44 and the projection 102 (see FIG. 1) is released so that the connection of the housing 30 and the mating housing 100 can be released.

The side walls 50 project up from the upper surface of the rear receptacle 33 and are arranged laterally to the lock arm 40. Two guide grooves 51 and two guide grooves 52 extending along a sliding direction (front-rear direction Y) of the connector position assurance member 60 (see FIG. 2) are provided side by side in the vertical direction Z in facing surfaces of the side walls 50 facing each other. The guide grooves 52 are provided above the guide grooves 51. The bottom surface of each guide groove 51 is inclined down toward the other guide groove 51 facing in the width direction X. The bottom surface of each guide groove 52 is an inclined surface inclined down toward the other guide groove 52 facing in the width direction X.

Here, "facing" or "substantially facing" in this specification means both a state where target surfaces are facing right opposite to each other and a state where target surfaces are facing the mating surfaces while being inclined with respect to the mating surfaces.

Each side wall 50 has an extended wall 53 extending rearward from the facing surface in which the guide grooves 51, 52 are formed. Facing surfaces of the extended walls 53 facing each other are flat surfaces. Specifically, the guide grooves 51, 52 are not formed in the facing surfaces of the extended walls 53.

(Configuration of Connector Position Assurance Member 60)

As shown in FIGS. 1 and 2, the connector position assurance member 60 is, for example, mounted slidably on the upper surface of the receptacle 31 and the upper surface of the lock arm body 42. The connector position assurance member 60 is provided between the side walls 50.

Figure 6:
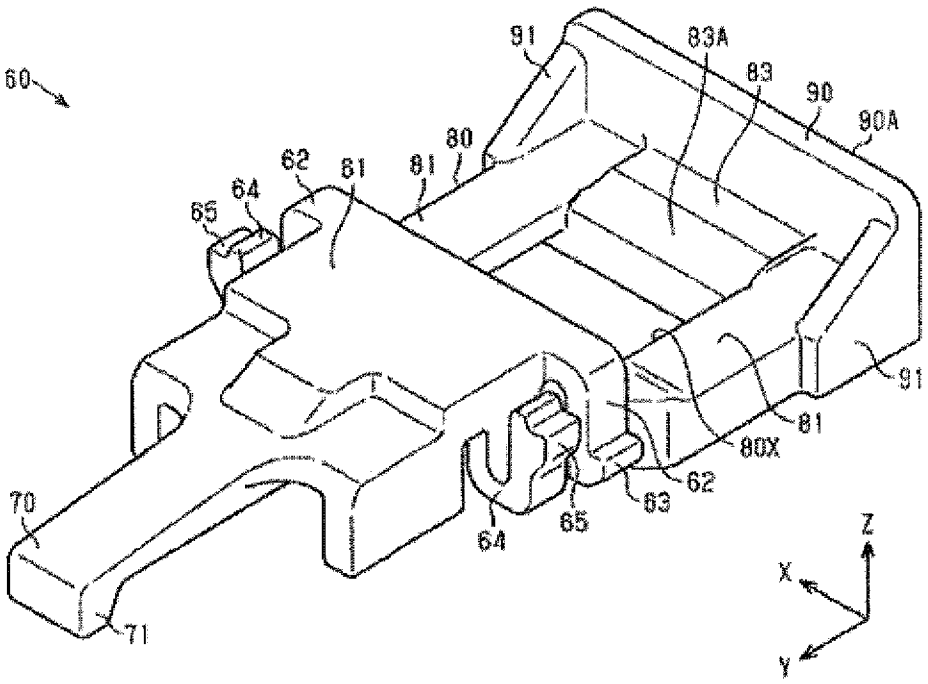
FIG. 6 is a front perspective view of a connector position assurance member of the one embodiment taken from an upper side.
Figure 7:
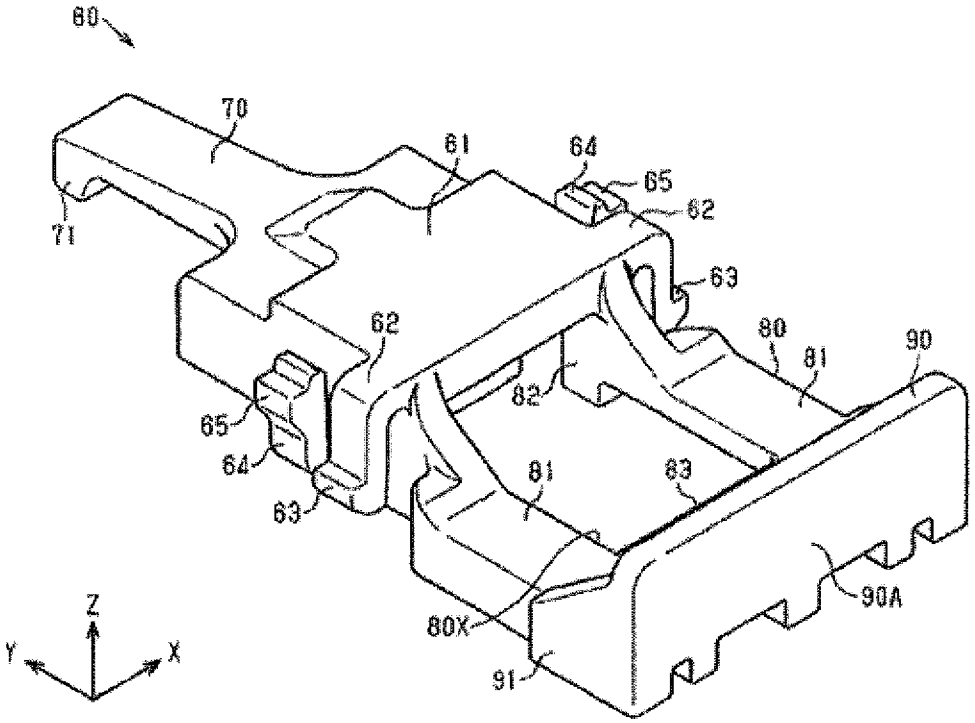
FIG. 7 is a rear perspective view of the connector position assurance member of FIG. 6.

As shown in FIGS. 6 and 7, the connector position assurance member 60 includes a body 61, a lock 70 projecting from one end (here, front end) of the body 61 and a push-in suppressing member 80 projecting from the other end (here, rear end) of the body 61.

(Configuration of Body 61)

The body 61 is, for example, in the form of a rectangular plate and arms 62 are formed on both left and right end parts of a rear end part of the body 61. The arms 62 are, for example, formed on both end parts in the width direction X of the body 61 and are flexible and resiliently displaceable in the width direction X. The arms 62 are cantilevered to project down from the both end parts in the width direction X of the body 61. A claw 63 is formed on or near a projecting tip part (here, lower part) of each arm 62 to project out in the width direction X.

Two arms 64 are formed on the both end parts in the width direction X of the body 61 at positions in front of the arms 62. The arms 64 are flexible and resiliently displaceable in the width direction X. The respective arms 64 project down from the both end parts in the width direction X of the body 61, and further are folded into a U shape to project up. A claw 65 is formed on a projecting tip part (upper end part) of each arm portion 64 and projects out in the width direction X. The claw portion 65 is provided above the claw portion 63.

Figure 8:
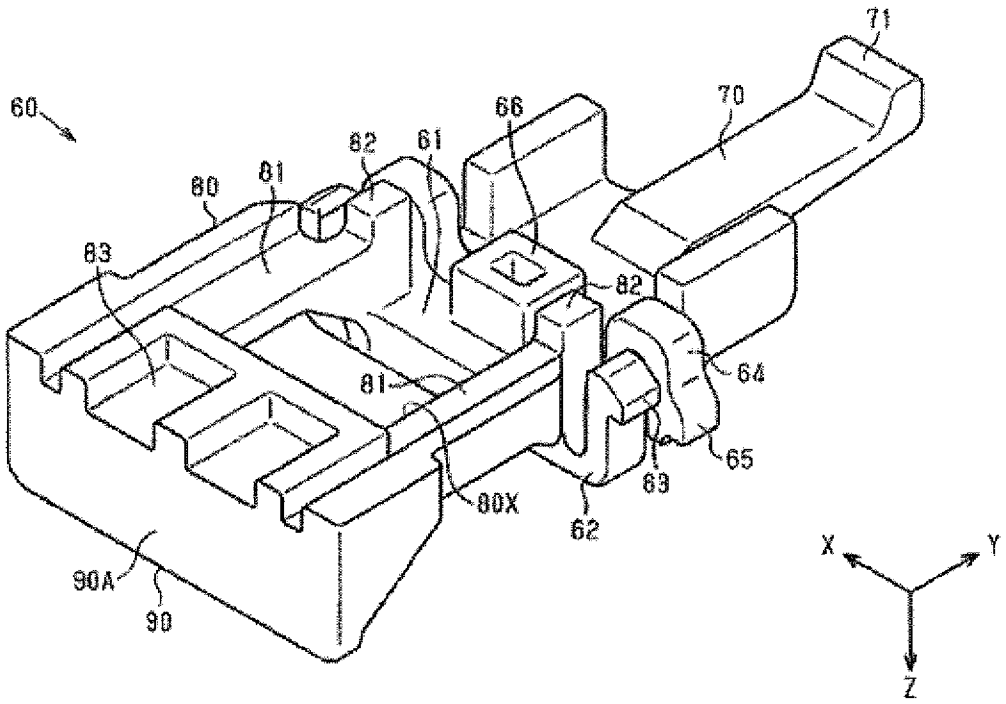
FIG. 8 is a rear perspective view of the connector position assurance member taken from a lower.

As shown in FIG. 8, an engaging portion 66 is formed on a facing surface (here, lower surface) of the body 61 facing the upper surface of the receptacle 31 (see FIG. 1). The engaging portion 66 projects down from the lower surface of the body 61 and is in the form of a rectangular or polygonal tube. The engaging portion is dimensioned to fit into the opening 42X of the lock arm body 42 shown in FIGS. 4 and 5.

(Configuration of Lock 70)

As shown in FIGS. 6 and 7, the lock 70 projects forward (first direction) from a front part (first end part) of the body 61. The lock 70 is, for example, a rectangular plate long in the front-rear direction Y. A dimension of the lock 70 in the width direction X is smaller than that of the body 61. The lock 70 is in the form of a cantilever having a base connected to the body 61 as a fixed end and a tip opposite to the base in a length direction of the connector position assurance member 60 as a free end. The lock 70 is flexible and resiliently displaceable. For example, the lock 70 is configured to deflect in the vertical direction Z by being resiliently deformed. As shown in FIG. 8, a claw 71 projects down in the vertical direction Z is formed on the lower surface of a tip part of the lock portion 70.

(Configuration of Push-In Suppressing Member 80)

The push-in suppressing member 80 projects rearward (second direction) from the rear part (second end part) of the body 61. The push-in suppressing member 80 is, for example, a frame body formed to extend along the length direction (here, front-rear direction Y) of the connector position assurance member 60 from the rear part of the body 61. The push-in suppressing member 80 includes, for example, an opening 80X having a rectangular or polygonal shape in a plan view.

The push-in suppressing member 80 includes, for example, two extended portions 81 extending in the length direction of the connector position assurance member 60 and an inserting portion 83 connecting rear parts of the extended portions 81. The push-in suppressing member 80 is formed into a frame by the extended portions 81, the inserting portion 83 and the body 61.

The extended portions 81 are separated from each other in the width direction X and extend parallel to each other along the front-rear direction Y. As shown in FIG. 7, each extended portion 81 is formed below the body portion 61. The upper surface of each extended portion 81 is below the upper surface of the body 61 and below the lower surface of the body 61. Columns 82 project down on the lower surface of the rear end part of the body 61. Each extended portion 81 of this embodiment extends rearward from the rear surface of the column 82. As shown in FIG. 3, each extended portion 81 is between the lock arm body 42 and the corresponding side wall 50 with the connector position assurance member 60 arranged at the connection assurance position CAP.

As shown in FIG. 6, the inserting portion 83 is on the projecting tip part (here, rear end part) of the push-in suppressing member 80, and the opening 80X of the push-in suppressing member 80 is in front of the inserting portion 83. The inserting portion 83 extends in the width direction X between the extended portions 81 and is, for example, a flat plate disposed below the body 61. The upper surface of the inserting portion 83 is below the upper surface of the body portion 61 and below the lower surface of the body 61. As shown in FIG. 2, the upper surface of the inserting portion 83 is formed below the lower surface of the connection releasing portion 45 with the connector position assurance member 60 mounted on the housing 30. As shown in FIG. 6, an inclined surface 83A is formed on the upper surface of the inserting portion 83 and is inclined down from the projecting tip part (here, rear end part) of the push-in suppressing member 80 toward an end (here, front end) thereof on the side of the body 61. The inclined surface 83A extends over the entire length of the inserting portion 83 in the width direction X and is formed continuously from a lengthwise intermediate part to a front part of the inserting portion 83.

As shown in FIG. 3, if the connector position assurance member 60 is arranged at the connection assurance position CAP, the inserting portion 83 is inserted into a space between the upper surface of the receptacle 31 and the lower surface of the connection releasing portion 45. Specifically, the inserting portion 83 is interposed between the receptacle 31 and the connection releasing portion 45 with the connector position assurance member 60 arranged at the connection assurance position CAP.

Note that part of the lower surface of the push-in suppressing member 80 contacts with the upper surface of the rear receptacle 33. For example, the connector position assurance member 60 slides between the connection assurance release position CARP (FIG. 2) and the connection assurance position CAP (FIG. 3) while the part of the lower surface of the connector position assurance member 60 slides on the upper surface of the rear receptacle 33.

As shown in FIG. 6, the connector position assurance member 60 includes an operating portion 90 in the form of a flat plate projecting up from the upper surface of the projecting tip (here, rear end) of the push-in suppressing member 80. The operating portion 90 extends over the entire length of the connector position assurance member 60 in the width direction X and extends over the entire length of the push-in suppressing member 80 in the width direction X. For example, the operating portion 90 extends in the width direction X over one extended portion 81, the inserting portion 83 and the other extended portion 81. The operating portion 90 is, for example, perpendicular to the upper surfaces of the extended portions 81, and the upper surface of the operating portion 90 is on the same plane as the upper surface of the body 61. As shown in FIG. 3, the upper surface of the operating portion 90 is above that of the connection releasing portion 45 with the connector position assurance member 60 mounted on the housing 30. As shown in FIG. 7, a rear surface 90A of the operating portion 90 extends in the width direction X and the vertical direction Z.

The connector position assurance member 60 includes connecting portions 91 connecting end surfaces in the width direction X of the extended portions 81 and end surfaces in the width direction X of the operating portion 90. The connecting portion 91 covers a part of the end surface in the width direction X of the extended portion from outside in the width direction X and projects farther out in the width direction X than the end surface in the width direction X of the extended portion 81. The upper surface of the connecting portion 91 is inclined down or in from the side of the operating portion 90 toward the side of the body 61. As shown in FIG. 2, the end surface facing out in the width direction X faces the facing surface of the extended wall 53 with the connector position assurance member 60 mounted on the housing 30.

(Mounting Method of Connector Position Assurance Member 60)

To mount the connector position assurance member 60 shown in FIG. 1 on the housing 30, the claws 63 of the arms 62 of the connector position assurance member 60 are inserted into the guide grooves 52 of the side walls 50. Subsequently, the connector position assurance member 60 is pressed down so that the arms 62 slide on inclined surfaces, which are the bottom surfaces of the guide grooves 52, and deflect toward the other arms 62 facing in the width direction X. Further, the arms 64 slide on upper end parts of the two side walls 50 and deflect toward the other arms 64 facing in the width direction X. In this way, the arms 62 come out of the guide grooves 52 and the arms 64 are disengaged from the upper end parts of the side walls 50. Downward displacement of the connector position assurance member 60 is stopped at the proper position when the lower surface of the body 61 contacts the upper surface of the lock arm body 42.

Figure 9:
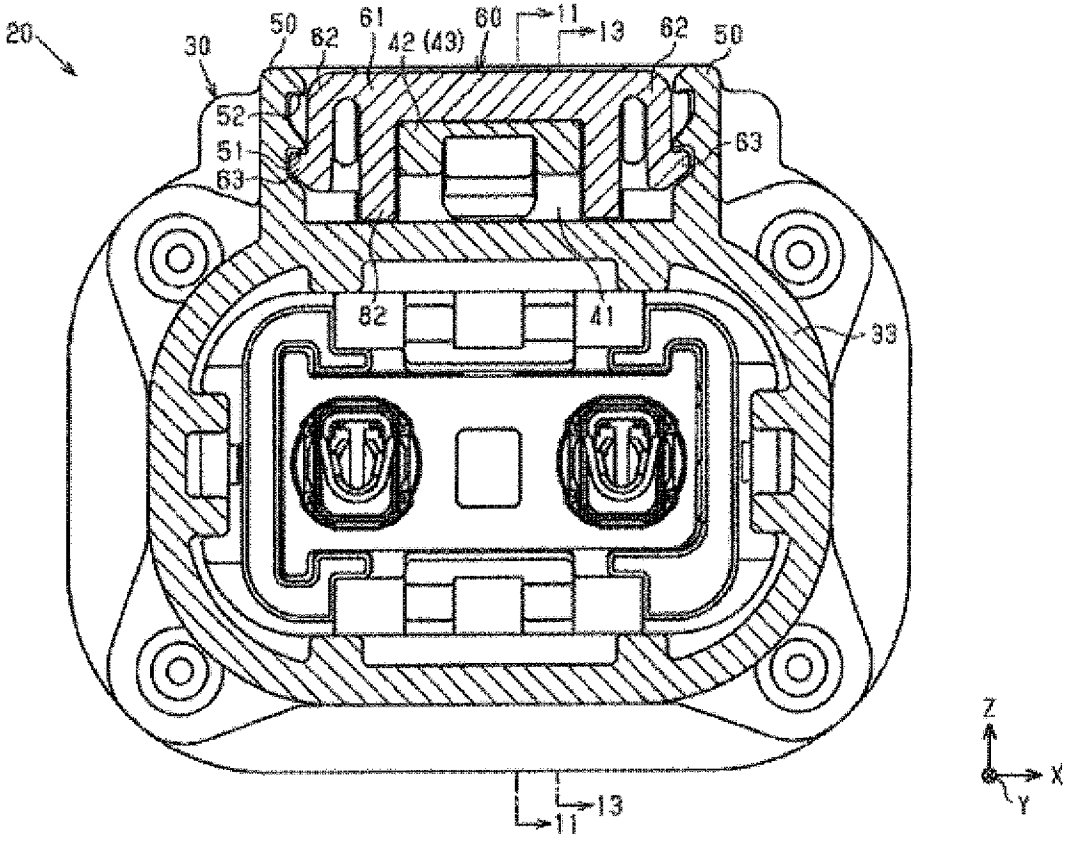
FIG. 9 is a horizontal section showing the connector.

At this time, as shown in FIG. 9, the deflected arms 62 restore, i.e. the arms 62 resiliently return to an initial shape, and the claws 63 on the projecting tip parts of the arms 62 enter the guide grooves 51 so that the upper surfaces of the claws 63 are locked to the ceiling surfaces of the guide grooves 51.

Figure 10:
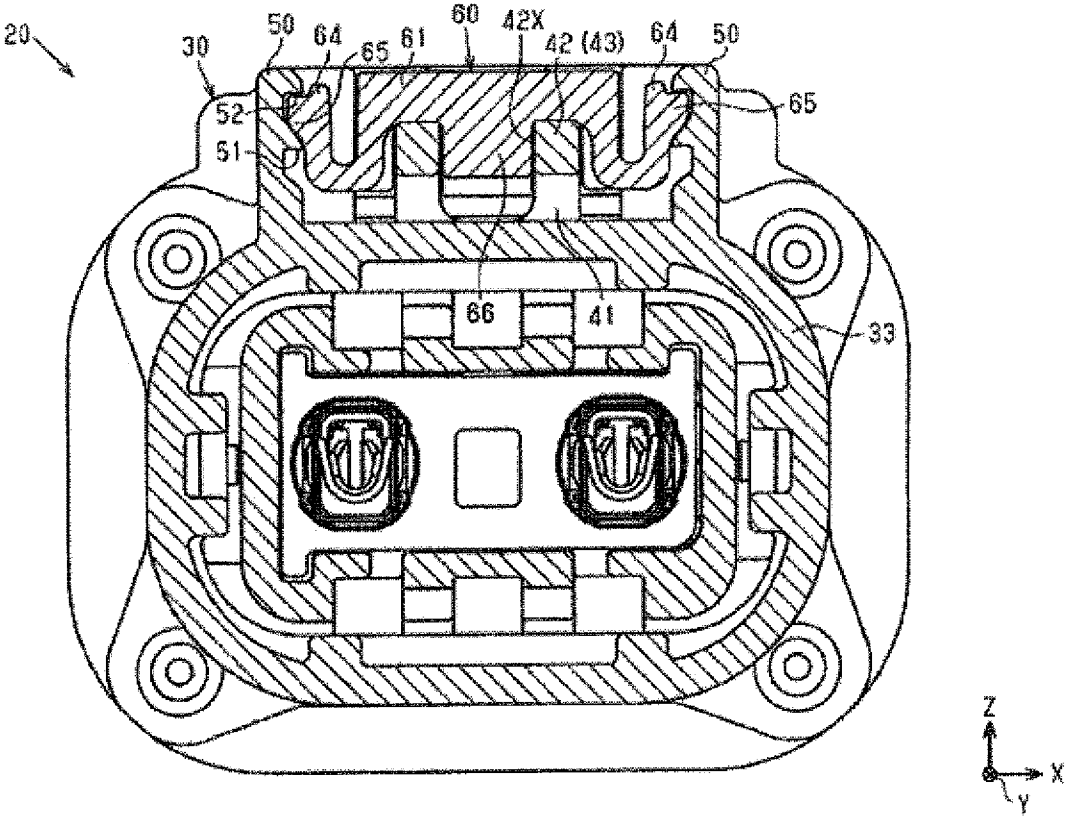
FIG. 10 is a schematic horizontal section showing the connector of the one embodiment.

Further, as shown in FIG. 10, the deflection of the arms 64 is restored, i.e. the arms 64 resiliently return to an initial shape, and the claws 65 on the projecting tip parts of the arms 64 enter the guide grooves 52 so that the upper surfaces of the claws 65 are locked to the ceiling surfaces of the guide grooves 52. Further, the engaging portion 66 formed on the lower surface of the body 61 is fit into the opening 42X of the lock arm body 42. The position of the connector position assurance member 60 at this time is the connection assurance release position CARP. By the above process, the connector position assurance member 60 can be mounted on the housing 30.

At the connection assurance release position CARP, a part of the lower surface of the body 61 of the connector position assurance member 60 is in contact with a part of the upper surface of the lock arm body 42. Further, the upper surfaces of the claws 65 of the arms 64 and the ceiling surfaces of the guide grooves 52 are in contact. Specifically, the arms 64 are in contact with the ceiling surfaces of the guide grooves 52 in a direction (here, upward direction) opposite to a direction from the lower surface of the body 61 toward the upper surface of the lock arm body 42 (here, downward direction). In this way, a displacement of the connector position assurance member 60 in the vertical direction Z is restricted and the rattling of the connector position assurance member 60 is suppressed.

As shown in FIG. 1, a part of the lower surface of the push-in suppressing member 80 is in contact with a part of the upper surface of the rear receptacle 33 at the connection assurance release position CARP. Further, the tip of the lock 70 is in contact with the rear surface of the locking portion 44.

(Connection of Housing 30 and Mating Housing 100)

Figure 11:
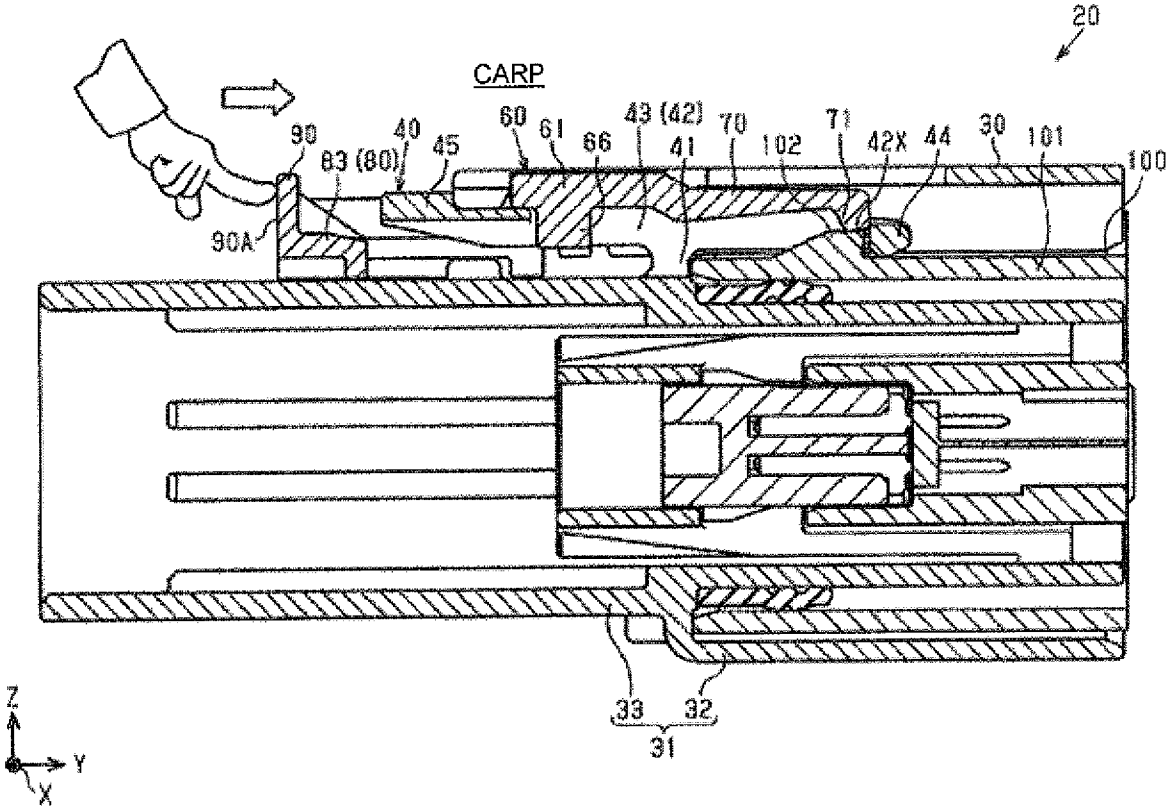
FIG. 11 is a cross-section taken along 11-11 of FIG. 9 and schematically showing the operation of the connector position assurance member.

Next, a state where the mating housing 100 is connected to the housing 30 having the connector position assurance member 60 mounted thereon as shown in FIG. 11 is described. If the mating housing 100 is connected properly to the housing 30, the projection 102 of the mating housing 100 is locked to the locking portion 44 of the lock arm 40.

More particularly, if the mating housing 100 is inserted to a back side of the mating housing 30 in the connecting direction, the projection 102 causes the locking portion 44 (lock arm body 42) to be resiliently displaced and deflected upward while sliding on the lower surface of the locking portion 44. Thus, the projection 102 rides over the locking portion 44 and moves to the back side in the connecting direction. If the projection 102 moves to the back side in the connecting direction beyond the locking portion 44, the locking portion 44 (lock arm body portion 42) resiliently returns to the initial shape and the projection 102 is locked to the locking portion 44.

Specifically, the front surface of the projection 102 is locked to the rear surface of the locking portion 44. If the projection 102 and the locking portion 44 are locked, the housing 30 and the mating housing 100 are connected properly. At this time, the projection 102 is fit into a front end of the opening 42X of the lock arm body 42. Further, the lock 70 of the connector position assurance member 60 is resiliently deformed to be deflected upward by the projection 102.

(Locking Operation of Connector Position Assurance Member 60)

Next, a locking operation of the connector position assurance member 60 is described. Specifically, an operation of displacing the connector position assurance member 60 from the connection assurance release position CARP towards or to the connection assurance position CAP is described.

With the housing 30 and the mating housing 100 properly connected, the connector position assurance member 60 arranged at the connection assurance release position CARP is slid forward along the front-rear direction Y (see an arrow in FIG. 11). Then, the lock 70 is deformed resiliently to be deflected up while the claw 71 provided on the tip of the lock 70 slides on the upper surface of the projection 102 and the upper surface of the locking portion 44 so that the claw 71 of the lock 70 rides over the locking portion 44.

Figure 12:
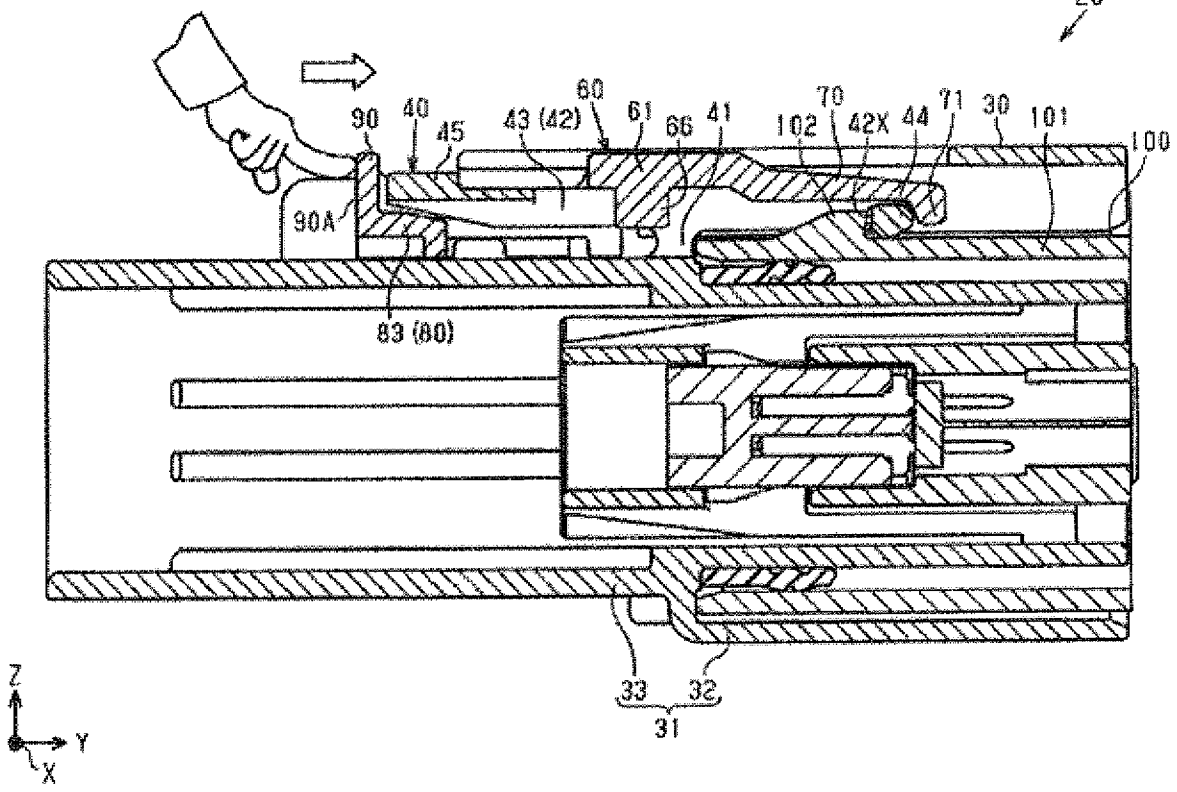
FIG. 12 is a cross-section taken along 11-11 of FIG. 9 and schematically showing the operation of the connector position assurance member.

As shown in FIG. 12, if the claw 71 of the lock 70 rides over the locking portion 44, the lock portion 70 resiliently returns to the initial shape and the claw 71 is locked by the locking portion 44. Specifically, the rear surface of the claw 71 is locked to the front surface of the locking portion 44. The position of the connector position assurance member 60 at this time is the connection assurance position CAP.

The connector position assurance member 60 of this embodiment can be displaced to the connection assurance position CAP by pushing the rear surface 90A of the operating portion 90 forward when being slid from the connection assurance release position CARP towards or to the connection assurance position CAP. Specifically, the connector position assurance member 60 of this embodiment can be slid from the connection assurance release position CARP to the connection assurance position CAP by one action of pushing the rear surface 90A of the operating portion 90 only in one direction, i.e. forward.

If the operating portion 90 is not present, the body 61 of the connector position assurance member 60 first is pressed down in the first action. Subsequently, in the second action, the connector position assurance member 60 is slid forward with the body 61 kept pressed down. As just described, if the operating portion 90 is not present, two actions are necessary in sliding the connector position assurance member 60 from the connection assurance release position CARP to the connection assurance position CAP. Thus, the locking operation of the connector position assurance member 60 is cumbersome if the operating portion 90 is not present. In contrast, with the connector position assurance member 60 of this embodiment, the operability of the locking operation of the connector position assurance member 60 is improved by providing the operating portion 90.

Figure 13:
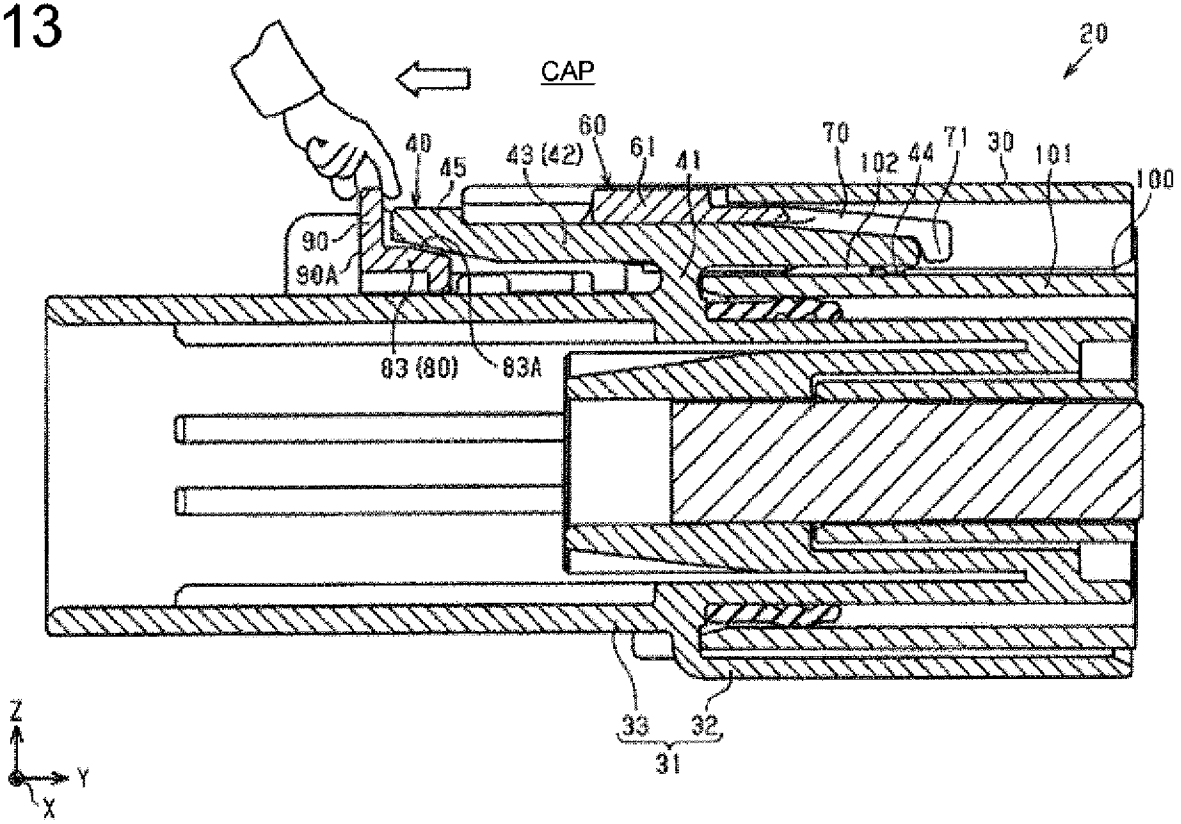
FIG. 13 is a cross-section taken along 13-13 of FIG. 9 and schematically showing the operation of the connector position assurance member.

As shown in FIG. 13, with the connector position assurance member 60 arranged at the connection assurance position CAP, the inserting portion 83 of the push-in suppressing member 80 of the connector position assurance member 60 is inserted between the lower surface of the connection releasing portion 45 and the upper surface of the rear receptacle 31. In this way, even if the connection releasing portion 45 is pushed excessively down toward the upper surface of the receptacle 31, downward pushing of the connection releasing portion 45 is suppressed due to the contact of the connection releasing portion 45 with the inserting portion 83. Thus, an upward displacement of the locking portion 44 is suppressed and unintended unlocking of the locking portion 44 and the projection 102 is suppressed.

The inclined surface 83A is formed on the upper surface of the inserting portion 83 and is inclined down toward the side of the body 61. This inclined surface 83A is inserted between the lower surface of the connection releasing portion 45 and the upper surface of the rear receptacle 33. Thus, the contact of the inserting portion 83 with the connection releasing portion 45 can be suppressed and the inserting portion 83 can be inserted between the lower surface of the connection releasing portion 45 and the upper surface of the rear receptacle 33. Here, at the connection assurance position, the height of the upper surface of the inserting portion 83 is set so that a clearance is formed between the upper surface of the inserting portion 83 and the lower surface of the connection releasing portion 45. In this way, an unintended displacement of the connection releasing portion 45 due to the insertion of the inserting portion 83 can be suppressed.

Further, as shown in FIGS. 2 and 3, the connector position assurance member 60 is slid along the front-rear direction Y with the connecting portions 91 of the connector position assurance member 60 facing the facing surfaces of the extended walls 53 in sliding the connector position assurance member 60 from the connection assurance release position CARP to the connection assurance position CAP. At this time, if the connector position assurance member 60 is inclined in the width direction X, the connecting portion 91 contacts the extended wall 53. Thus, the inclination of the connector position assurance member 60 in the width direction X can be suppressed by the contact of the connecting portion 91 and the extended wall 53.

As described above, with the housing 30 and the mating housing 100 properly connected, the connector position assurance member 60 can be displaced from the connection assurance release position CARP shown in FIG. 2 towards or to the connection assurance position CAP shown in FIG. 3. On the other hand, unless the housing 30 and the mating housing 100 are connected properly, the connector position assurance member 60 cannot be displaced from the connection assurance release position CARP towards or to the connection assurance position CAP. For example, such as when the projection 102 (see FIG. 13) of the mating housing 100 is right below or adjacent to the locking portion 44, the connector position assurance member 60 cannot be displaced to the connection assurance position CAP due to the contact of the tip of the lock 70 with the rear surface of the locking portion 44 even if the connector position assurance member 60 is slid forward from the connection assurance release position CARP.

(Connection Release of Housing 30 and Mating Housing 100)

Next, an operation of releasing the connection of the housing 30 and the mating housing 100 is described.

First, the connector position assurance member 60 at the connection assurance position CAP shown in FIG. 13 is pulled rearward along the front-rear direction Y and slid to the connection assurance release position CARP (see FIG. 11). At this time, the operating portion 90 projects up from the upper surface of the inserting portion 83 and the upper surface of the operating portion 90 is above the upper surface of the connection releasing portion 45. Specifically, the front surface of the operating portion 90 projects farther up than the upper surface of the connection releasing portion 45. Thus, the connector position assurance member 60 can be pulled rearward, for example, by hooking a finger on the front surface of the operating portion 90 projecting farther up than the upper surface of the connection releasing portion 45. In this way, operability in displacing the connector position assurance member 60 from the connection assurance position CAP to the connection assurance release position CARP is improved.

Figure 14:
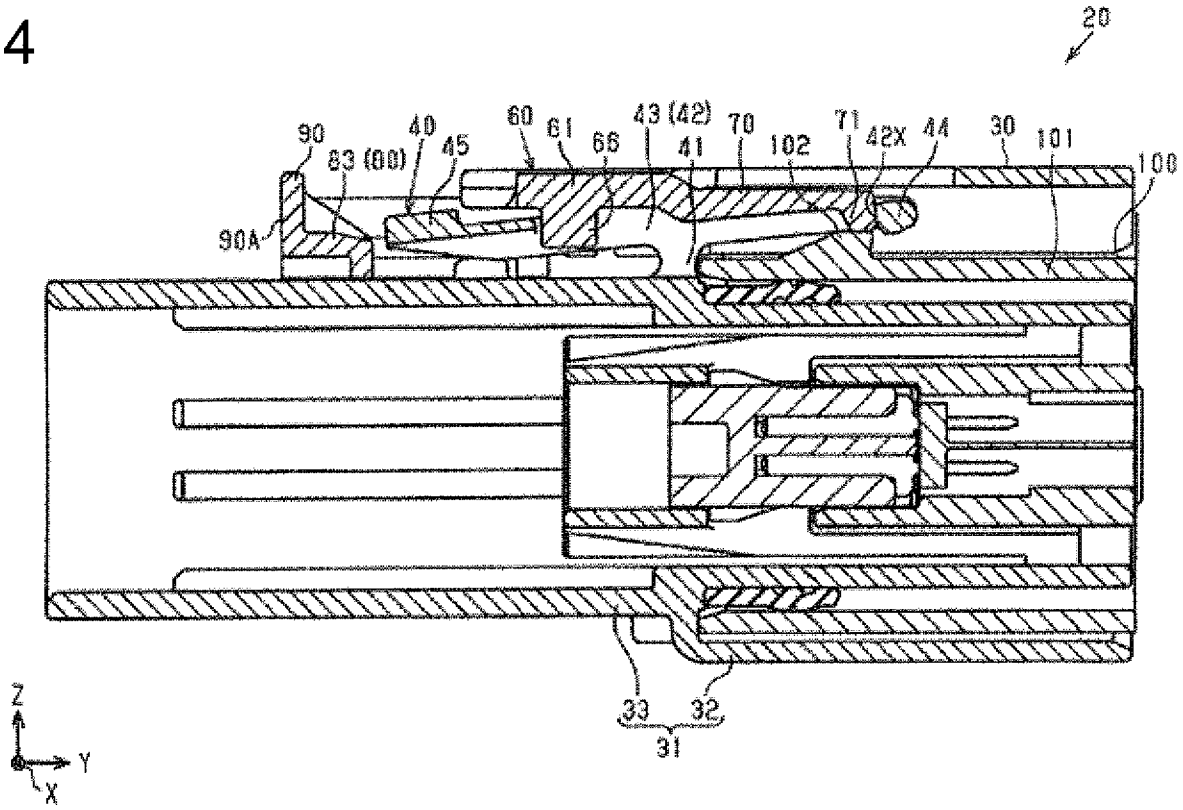
FIG. 14 is a cross-section taken along line 11-11 of FIG. 9 and schematically section showing a connection releasing operation of the connector.

Subsequently, as shown in FIG. 14, the connection releasing portion 45 is pressed down toward the upper surface of the rear receptacle 33. Then, the lock arm body 42 located in front of the base end 41 is displaced up with the base end 41 as a fulcrum and the locking portion 44 is displaced up. In this way, the locking of the locking portion 44 and the projection 102 is released.

If the mating housing 100 is pulled in a direction opposite to the connecting direction with the locking of the locking portion 44 and the projection 102 released in this way, the connection of the housing 30 and the mating housing 100 can be released and the mating housing 100 can be separated from the housing 30.

Next, functions and effects of this embodiment are described.

The connector position assurance member 60 is provided with the push-in suppressing member 80 (inserting portion 83) between the outer peripheral surface of the receptacle 31 and the connection releasing portion 45 with the connector position assurance member 60 at the connection assurance position CAP. According to this configuration, if the connection releasing portion 45 is pressed toward the outer peripheral surface of the receptacle 31 with the connector position assurance member 60 arranged at the connection assurance position CAP, the connection releasing portion 45 contacts the inserting portion 83 and excessive pushing of the connection releasing portion 45 is suppressed. In this way, an unintentional displacement of the locking portion 44 of the lock arm 40 is prevented so that the locking of the locking portion 44 and the projection 102 of the mating housing 100 is not released unintentionally. As a result, it can be suitably suppressed that the connection of the housing 30 and the mating housing 100 is not released unintentionally.

The inclined surface 83A is formed on the upper surface of the inserting portion 83 and is inclined down from the projecting tip (here, rear end) of the push-in suppressing member 80 toward the end of the inserting portion 83 on the side of the body 61. In this configuration, the part of the inserting portion 83 to be inserted first between the upper surface of the receptacle 31 and the lower surface of the connection releasing portion 45 is formed on the inclined surface 83A. In this way, the contact of the inserting portion 83 with the connection releasing portion 45 can be suppressed when inserting the inserting portion 83 between the upper surface of the receptacle 31 and the lower surface of the connection releasing portion 45. As a result, an unintended displacement of the connection releasing portion 45 can be suitably suppressed.

The connector position assurance member 60 is provided with the operating portion 90 in the form of a flat plate projecting up from the upper surface of the projecting tip part of the push-in suppressing member 80. According to this configuration, the connector position assurance member 60 is provided with the operating portion 90 extending in a plane orthogonal to the sliding direction of the connector position assurance member 60. By pushing this operating portion 90 in the sliding direction, the entire connector position assurance member 60 can be moved in the sliding direction. By pushing the operating portion 90 only in one direction in this way, the entire connector position assurance member 60 can be moved in the sliding direction and the connector position assurance member 60 can be displaced from the connection assurance release position CARP to the connection assurance position CAP. In this way, the operability of the operation of displacing the connector position assurance member 60 to the connection assurance position CAP is improved.

The operating portion 90 extends over the entire length in the width direction orthogonal to the length direction of the connector position assurance member 60. According to this configuration, the operating portion 90 has a wider surface area and easily is pushed in the sliding direction. In this way, the operability of the operation of displacing the connector position assurance member 60 to the connection assurance position CAP is improved.

The upper surface of the operating portion 90 projects farther up than the upper surface of the connection releasing portion 45. In this way, the front surface of the operating portion 90 partially projects farther up than the upper surface of the connection releasing portion 45. Thus, the connector position assurance member 60 can be pulled rearward, for example, by hooking a finger on the front surface of the operating portion 90 projecting farther up than the upper surface of the connection releasing portion 45. In this way, operability in displacing the connector position assurance member 60 from the connection assurance position CAP to the connection assurance release position CARP can be improved.

The connector position assurance member 60 includes the connecting portions 91 connecting the end surfaces in the width direction X of the push-in suppressing member 80 and the end surfaces in the width direction X of the operating portion 90. The connecting portions 91 are arranged between the side walls 50 (here, extended walls 53) provided on the receptacle 31. According to this configuration, the connecting portion 91 can be brought into contact with the side wall 50 if the connector position assurance member 60 is inclined in the width direction such as when the connector position assurance member 60 moves along the sliding direction. The inclination of the connector position assurance member 60 in the width direction can be suppressed by the contact of the connecting portion 91 and the side wall 50.

The connecting portions 91 connect the end surfaces in the width direction X of the push-in suppressing member 80 and the end surfaces in the width direction X of the operating portion 90, the rigidity of the entire push-in suppressing member 80 can be enhanced.

The connector position assurance member 60 is mounted on the housing 30 so that the engaging portion 66 on the lower surface of the body 61 is fit into the opening 42X of the lock arm 40. Thus, the engaging portion 66 can be moved in the opening 42X in displacing the connector position assurance member 60 between the connection assurance release position CARP and the connection assurance position CAP. In this way, a movement of the engaging portion 66 is guided by a frame of the opening 42X, specifically by the arms 43 to suppress inclination of the connector position assurance member 60.

Other Embodiments

The above embodiment can be modified and/or carried out as follows. The above embodiment and the following modifications can be carried out in combination without technically contradicting each other.

The arms 62 and the claws 63 may be omitted from the connector position assurance member 60 of the above embodiment.

The arms 64 and the claws 65 may be omitted from the connector position assurance member 60 of the above embodiment.

The engaging portion 66 may be omitted from the connector position assurance member 60 of the above embodiment.

The connecting portions 91 may be omitted from the connector position assurance member 60 of the above embodiment.

The operating portion 90 is so formed that the upper surface thereof is above that of the connection releasing portion 45 in the above embodiment. However, the upper surface of the operating portion 90 may be formed on the same plane as the upper surface of the connection releasing portion 45 or may be provided below the upper surface of the connection releasing portion 45.

The operating portion 90 extends over the entire length in the width direction X of the push-in suppressing member 80 in the above embodiment, but may be formed only on a part of the push-in suppressing member 80 in the width direction X.

The operating portion 90 may be omitted from the connector position assurance member 60 of the above embodiment.

Although the push-in suppressing member 80 is in the form of a frame having the opening 80X in the above embodiment, there is no limitation to this. For example, the opening 80X may be omitted and the entire push-in suppressing member 80 may be in the form of a flat plate if the push-in suppressing member 80 does not contact the lock arm 40 in displacing the connector position assurance member 60 between the connection assurance position CAP and the connection assurance release position CARP.

The inclined surface 83A of the inserting portion 83 of the above embodiment may not be formed.

The extended walls 53 may be omitted from the housing 30.

The embodiment disclosed this time should be considered as not restrictive, but illustrative in all aspects. The scope of the invention is intended to be represented by claims and include all changes in the scope of claims and in the meaning and scope of equivalents.

REFERENCE NUMERALS

W1 wiring harness
10 wire
11 conductive path
12 coating member
20 connector
30 housing
31 receptacle
32 front receptacle
33 rear receptacle
40 lock arm
41 base end
42 lock arm body
42X opening
43 arm
44 locking portion
45 connection releasing portion
50 side wall
51 guide groove
52 guide groove
53 extended wall
60 connector position assurance member
61 body
62 arm
63 claw
64 arm
65 claw
66 engaging
70 lock
71 claw
80 push-in suppressing member
80X opening

81 extended portion
82 column
83 inserting portion
83A inclined surface
90 operating portion
90A rear surface
91 connecting portion
100 mating housing
101 mating receptacle
102 projection

What is claimed is:

1. A connector (20), comprising:

a housing (30) having a front end to be connected to a mating housing (100) and a rear end opposite the front end; and a connector position assurance member (60) for performing connection assurance of the housing (30) and the mating housing (100), wherein:

the connector position assurance member (60) is mounted on the housing (30) relatively displaceably in opposite forward and rearward directions between a connection assurance position (CAP) where the connection assurance is performed and a connection assurance release position (CARP) where the connection assurance is released with the housing (30) and the mating housing (100) properly connected, the connector position assurance member (60) includes a body (61) with opposite front and rear ends, a resiliently displaceable lock (70) projecting in a forward direction from the front end of the body (61) and a suppressing member (80) projecting in a rearward direction substantially opposite to the forward direction from the rear end of the body (61), a claw (71) projecting from a front end of the lock (70), the housing (30) includes a receptacle (31) and a lock arm (40) provided on an outer peripheral surface of the receptacle (31), the lock arm (40) includes a locking portion (44) to be locked to a single projection (102) of the mating housing (100) and a connection releasing portion (45) for displacing the locking portion (44) by being displaced toward the outer peripheral surface of the receptacle (31), and the lock (70) is locked to the locking portion (44) so that the locking portion (44) is engaged between the claw (71) and the single projection (102) in the forward and rearward directions, and the suppressing member (80) is arranged between the outer peripheral surface of the receptacle (31) and the connection releasing portion (45) with the connector position assurance member (60) arranged at the connection assurance position (CAP).

2. The connector of claim 1, wherein:

the lock arm (40) includes a base end (41) projecting out from the outer peripheral surface of the receptacle (31) and a lock arm body (42) having a lengthwise intermediate part coupled to a projecting tip of the base end (41), the locking portion (44) is formed on a front end part of the lock arm body (42) and the connection releasing portion (45) is formed on a rear end part of the lock arm body (42), a space is formed between the connection releasing portion (45) and the outer peripheral surface of the receptacle (31) with the connector position assurance member (60) arranged at the connection assurance release position (CARP), and at least part of the suppressing member (80) is arranged in the space with the connector position assurance member (60) arranged at the connection assurance position (CAP).

3. The connector of claim 2, wherein:

the suppressing member (80) is arranged on an upper surface of the receptacle (31), the suppressing member (80) is a frame substantially extending in a length direction of the connector position assurance member (60) from an end part of the body (61), an inserting portion (83) substantially in the form of a flat plate is provided on a projecting tip part of the suppressing member (80), an upper surface of the inserting portion (83) is provided below an upper surface of the body (61), and the inserting portion (83) is slidable on an upper surface of the receptacle (31) with the inserting portion (83) inserted at least partly between the upper surface of the receptacle (31) and a lower surface of the connection releasing portion (45) with the connector position assurance member (60) arranged at the connection assurance position (CAP).

4. The connector of claim 2, wherein:

the connector position assurance member (60) moves in a sliding direction from the inserting portion (83) toward the body (61) when being displaced from the connection assurance release position (CARP) to the connection assurance position (CAP), and an inclined surface (83A) is formed on an upper surface of the inserting portion (83) and is inclined down toward an end part of the inserting portion (83) on a side facing toward the body (61), the inclined surface (83A) engaging the lower surface of the connection releasing portion (45) of the lock arm (40) and a lower surface of the inserting portion (83) engaging the outer peripheral surface of the receptacle (31) with the connector position assurance member (60) arranged at the connection assurance position (CAP).

5. The connector of claim 2, wherein the connector position assurance member (60) further includes an operating portion (90) substantially in the form of a flat plate projecting out from an outer surface of the suppressing member (80) and projecting to a position farther from the receptacle (31) than the connection releasing portion (45) of the lock arm body (42).

6. The connector of claim 5, wherein the operating portion (90) extends over substantially an entire width orthogonal to the forward and rearward directions of the connector position assurance member (60).

7. The connector of claim 5, wherein:

the connector position assurance member (60) further includes connecting portions (91) connecting widthwise end surfaces of the suppressing member (80) and widthwise end surfaces of the operating portion (90), the housing (30) further includes two side walls (50) formed on the receptacle (31) to sandwich the lock arm (40), and the connecting portions (91) are arranged between the side walls (50).

8. The connector of claim 1, wherein:

the lock arm (40) is a frame having an opening (42X), an engaging portion (66) projecting toward the receptacle (31) is formed on a surface of the body (61) facing toward the receptacle (31), and the connector position assurance member (60) is mounted on the housing (30) so that the engaging portion (66) is fit at least partly into the opening (42X).

9. A wiring harness, comprising:

the connector (20) of claim 1, and a wire (10) connected to the connector (20).

* * * * *